US007775251B2

(12) United States Patent
Ward

(10) Patent No.: US 7,775,251 B2
(45) Date of Patent: Aug. 17, 2010

(54) CUSTOMIZABLE SNAP-ON GARAGE DOOR SCREEN AND METHOD

(76) Inventor: James K. Ward, 5072 Golfside Dr., Frisco, TX (US) 75035

( * ) Notice: Subject to any disclaimer, the term of this patent is extended or adjusted under 35 U.S.C. 154(b) by 230 days.

(21) Appl. No.: 12/188,225

(22) Filed: Aug. 8, 2008

(65) Prior Publication Data

US 2010/0032108 A1 Feb. 11, 2010

(51) Int. Cl.
*A47H 1/00* (2006.01)

(52) U.S. Cl. ..... 160/89; 160/90; 160/368.1

(58) Field of Classification Search ..... 160/368.1, 160/87, 89, 90
See application file for complete search history.

(56) References Cited

U.S. PATENT DOCUMENTS

| | | | | |
|---|---|---|---|---|
| 3,455,366 | A | 7/1969 | Bogumil | |
| 3,480,069 | A * | 11/1969 | Handwerker | 160/354 |
| 4,100,957 | A * | 7/1978 | Shelton | 160/368.1 |
| 4,852,194 | A * | 8/1989 | Langan | 5/427 |
| 5,427,169 | A | 6/1995 | Saulters | |
| 6,079,473 | A | 6/2000 | Ackerson, II et al. | |
| 6,257,307 | B1 | 7/2001 | Tolliver | |
| 7,299,849 | B2 | 11/2007 | Haney | |
| 2002/0062930 | A1 | 5/2002 | Jennings | |
| 2003/0070769 | A1 | 4/2003 | Lampers | |
| 2004/0221973 | A1 * | 11/2004 | Hesse | 160/368.1 |
| 2005/0241783 | A1 * | 11/2005 | Geres | 160/368.1 |
| 2007/0138456 | A1 * | 6/2007 | Clark | 256/24 |

* cited by examiner

*Primary Examiner*—Blair M. Johnson
(74) *Attorney, Agent, or Firm*—Carl F. Melito

(57) ABSTRACT

A customizable garage door screen is disclosed that requires few components to deploy and store. Four elastic straps with hooks at each end are used with six grommets strategically placed on the screen for stability, and approximately one dozen screw and snap fasteners are installed around the perimeter of the screen and garage door frame for a tight enclosure to keep out pests. A partially oversized screen that can fit the average American garage door frame and requires little pre-fabrication effort is now possible with so few components. To open the garage door screen for egress and ingress, one simply unhooks one or both of the lower elastic straps, after unsnapping the desired number of end-caps, and latching upon the upper elastic straps or guide rails on either side. The elastic straps are also used to store the folded screen inside the top, backside of the garage door.

19 Claims, 5 Drawing Sheets

CUSTOMIZABLE SNAP-ON GARAGE DOOR SCREEN AND METHOD

BACKGROUND

The present invention pertains to removable single and double car garage door screens that are simple and inexpensive to make, install and store, and are easily opened for pass-through, without unnecessary zippers, dowel rods, and other costly components.

Garage door screens have been successfully employed for many years. When the first garage door screens were demonstrated, the application as a pest barrier was obvious to all. The capability to allow in air and light, without also allowing in insects, proved quite useful. The West Nile virus carried by mosquitoes in the United States has made garage door screens all the more important in recent years. Early systems were based upon a tight enclosure around the perimeter of the garage door frame using expensive means such as elongated channels connected to the garage door frame holding border strips attached to the screen, or magnetic means or adhesive Velcro® strips, and the like, installed in similar manner. Other means of securing garage door screens employed a plurality of fasteners such as hooks, secured about the periphery of the garage door opening. They became more effective when they were combined with dowel rods inserted into hems sewn in at the bottom of the screen for weighted adherence to the garage floor and which were also used as spindles for rolling up the screen for storage. Other screens used vertical elastic strips sewn into the fabric of the screen for stretching the screen material to accommodate variations among garage door opening sizes.

The recent trend has been toward offering greater varieties of screen attributes, such as providing various screen colors and degrees of ultraviolet (UV) protection, various thicknesses and counts of strands per square inch that vary greatly in cost. Some screens provide more privacy, allowing one to see out, but not in. For instance, a light double car garage screen may have as few as 12 by 12 strands per square inch and would provide no privacy, but might only cost $30.00 to purchase from the manufacturer. Whereas, a much heavier screen of the same size that may be 20 by 24 strands per square inch and which may provide 80-90% UV protection may provide complete privacy from the outside looking in and be easy to see out from the inside, might cost into the hundreds of dollars. Thus it is becoming ever more difficult to manufacture garage door screens to accommodate the different available types of screen offerings and sizes, and to accommodate differing requirements of each consumer in a cost effective manner.

For the foregoing reasons, there is a clear, and now long felt, need for an inexpensive to produce, customizable garage door screen (hereinafter "screen", "garage screen" or "garage door screen" will be used as equivalent expressions) that is made large enough to fit any single or double car garage door frame built in the United States, but is flexible enough to maintain a tight, stable enclosure around the perimeter of the garage door frame and which allows ingress and egress without expensive zippers or elastic strips that must be sewn-in in advance. What is further needed is a method of storing the garage door screen without additional installed components or which might require substantial effort and storage space. A simple garage door screen made of a minimum of component parts that accomplishes all the aforementioned objectives is a need yet to be satisfied.

SUMMARY

A customizable snap-on garage door screen and storage method is disclosed for single and double car garages in the United States whose standard dimensions are approximately 85½ inches by 97 inches and 85½ inches by 195 inches, respectively. Because of the enormous variety of screen material now available to satisfy the different needs and wants reflecting a wide range of consumer tastes, it is contemplated that each garage door screen purchase begins with the consumer's selection of the type of material desired and whether the order is for a single or double car garage, or the size dimensions required, if they vary dramatically from standard dimensions. The screen type and size combine to be the single most important cost factor of the purchase, because the screen material of the present invention varies widely in cost depending on its type and size and comprises 80-90% or more of the overall cost to make the invention. All other costs are fixed costs and are kept to an absolute minimum to enable a cost effective customizable screen option.

The present invention is based upon the application of a minimum number of component parts to achieve the desired functionality of a garage door screen that keeps out pests, allows in air and light, allows egress and ingress, can be partially opened from the bottom across its length, provides for effective storage, requires simple initial installation, and is easy to put up and to take down after use. Since there are a minimum of component parts, and no sewing of hems on the screen is required, a customized screen can be produced at very low cost in a very short period of time in lieu of unjustified costly mass production runs of a pre-fabricated, manufactured product.

The elements of the present invention include a garage door screen that is selected according to the specific needs of the consumer including size (i.e. single or double car configuration or non-standard size) and type of screen (i.e. thickness, color, level of UV protection, privacy characteristics, etc). For a single car garage configuration, the screen size will be approximately 91 inches by 101 inches, which is at least four inches longer in height and width than the average single car garage door frame in the United States. In one embodiment of the present invention, the component parts for a single car garage screen will include the following, but may vary depending on customer requirements: 11 screw and snap fasteners, whose end-caps will be pre-installed around the screen's perimeter (excluding the bottom) with four of the end-caps ½ inch by ½ inch in from each corner and the other seven end-caps placed ½ inch in and equidistant from each other and the corner end-caps, three on the left and right sides and one in the middle along the top; four 36 inch elastic straps stretchable to 54 inches having hooks on each end approximately ¼ inch in diameter in thickness; and six grommets each having a hole approximately ½ inch in diameter to allow at most two hooks to be inserted therein, pre-installed on the screen, three going horizontally across the top, each placed approximately eight inches down from the top edge of the screen, one in the middle of the screen and the other two grommets four inches in from each side. The bottom three grommets are configured with the same horizontal dimensions as the top three grommets and are approximately one inch up from the screen's bottom edge.

For a double car garage configuration, the screen size will be approximately 91 inches by 199 inches, which is at least four inches longer in height and width than the average single car garage door frame in the United States. In one embodiment of the present invention, the component parts for a single car garage screen will include the following, but may vary depending on customer requirements: 13 screw and snap fasteners, whose end-caps will be pre-installed around the screen's perimeter (excluding the bottom) with four of the end-caps ½ inch by ½ inch in from each of the four corners of the screen and the other nine end-caps placed ½ inch in and equidistant from each other and the corner end-caps, three on each side (excluding the bottom). In another embodiment, different fasteners such as pieces of Velcro®, nails, tacks, hooks, magnets, ties, ribbons, strings, buttons, tape pieces, and the like, are contemplated such that the screen comprises attaching at least four fasteners on four corners of the screen and a plurality of additional fasteners on the screen in symmetrical manner between each of said at least four fasteners; 65 inch elastic straps having hooks on each end stretchable to 98 inches, the hooks being approximately ¼ inch in diameter in thickness; and six grommets each having a hole approximately ½ inch in diameter to allow at most two hooks to be inserted therein, pre-installed on the screen, three going horizontally across the top, each placed approximately eight inches down from the top edge of the screen, one in the middle of the screen and the other two grommets four inches in from each side. The bottom three grommets are configured with the same horizontal dimensions as the top three grommets and are approximately one inch up from the screen's bottom edge. Alternative names for the these grommets are: top middle grommet and two top outer grommets on each vertical side of the screen and bottom middle grommet and two bottom outer grommets on each vertical side of the screen. (Note: For clarity, an equivalent expression for the above configuration of grommets is that at least six grommets are used, wherein three of said at least six grommets are spaced across a top portion of the screen and another three of said at least six grommets are spaced across a bottom portion of the screen).

For the sake of brevity, the remainder of this specification, including the drawings, will refer to the double car garage configuration above by example, but it should be understood to also apply in relative manner to the single car garage screen configuration.

The present invention provides for significant cost savings to meet a wide range of functional requirements of the consumer that are unknown prior to the order. The present invention satisfies the long felt need for an inexpensive way to provide a customized garage door screen to the consumer by minimizing the amount of work that must be done to the screen prior to shipment, thus enabling cost effective custom ordering. For example, the customizable garage door screen and storage method of the present invention eliminates the need for a dowel rod, spindle or other like components for rolling up the screen for storage. The present invention comprises the capability of storing the garage door screen safely inside the back upper portion of the garage door itself using the four provided elastic straps to hold it in place after the screen is folded in half. The grommets located at the top and bottom portions of the garage door screen are aligned after folding so that the hooks of two of the elastic straps simultaneously attach them from the shared middle grommets through the two shared side grommets on each side of the top back of the garage door, and the other two elastic straps are hooked together inside the fold at the midway point and stretched to either side to each edge of the garage door at its' middle. The outer four hooks embrace the two vertical sides of the garage door itself.

When installed under one embodiment of the present invention, the garage door screen uses two elastic straps and their attached hooks to pull the top middle grommet horizontally outward through each respective top outer grommet across the top of the screen to embrace the bottom portion of the vertical sides of the open garage door for enhanced vertical support (i.e. at a left vertical side of a bottom of an open garage door and at a right vertical side of a bottom of an open garage door, respectively), and the outer hooks of the other two elastic straps are configured in like manner to embrace the guide rails that run vertically along each side adjacent to each side at the bottom portion of the screen. When installed under another embodiment of the present invention, all four elastic straps and their attached hooks pull the middle grommets horizontally outward through each respective side grommet (upper and lower outer grommets) across the screen to embrace the top and bottom portions of the vertical guide rails (left and right guide rails). This provides tension for the variable sized screen for stability, with the excess screen along the three sides wrinkled, to some extent, around the edges, thus eliminating the need for the weight of a dowel rod to provide support at the bottom portion of the screen.

After the initial installation of the self-tapping screw and snap fastener snaps (hereinafter "snap(s)") along the inside of the garage door frame corresponding to the placement of the screw and snap fastener end-caps (hereinafter "end-cap(s)") pre-installed around the provided garage door screen of the present invention, all one has to do to put up the screen thereafter is to place the hooks into the top middle grommet from two of the provided elastic straps and to stretch them to each side, placing the hooks adjacent to the bottom of the open garage door sides, one at a time, if enhanced vertical support is desired, otherwise place the hooks adjacent the upper portion of the guide rails. Do the same on the bottom portion of the screen with the other two elastic straps, and place the outer hooks adjacent to the bottom portion of guide rails in like manner. Then snap in each of the end-caps to its corresponding snap, ensuring a tight enclosure around the perimeter of the screen.

The garage door screen is safely stored inside the garage door itself using the four provided elastic straps and their attached hooks to hold it in place inside the back of a garage door after the screen is folded in half. To open at least one side of the garage door screen for egress and ingress, one simply unsnaps the desired number of end-caps on the side to be opened corresponding to the desired height of the opening and then unhooks the lower elastic strap on that side, lifting it upwards and placing the hook just released from the guide rail on that side to an elevated position further up on the guide rail or inside the hole of the upper grommet on that side, or alternatively around one of the upper elastic straps near the upper middle grommet. If the entire bottom half of the garage door screen is to be opened, one simply does the same to the other side.

DRAWINGS

DETAILED DESCRIPTION OF THE PREFERRED EMBODIMENTS

Figure 1:
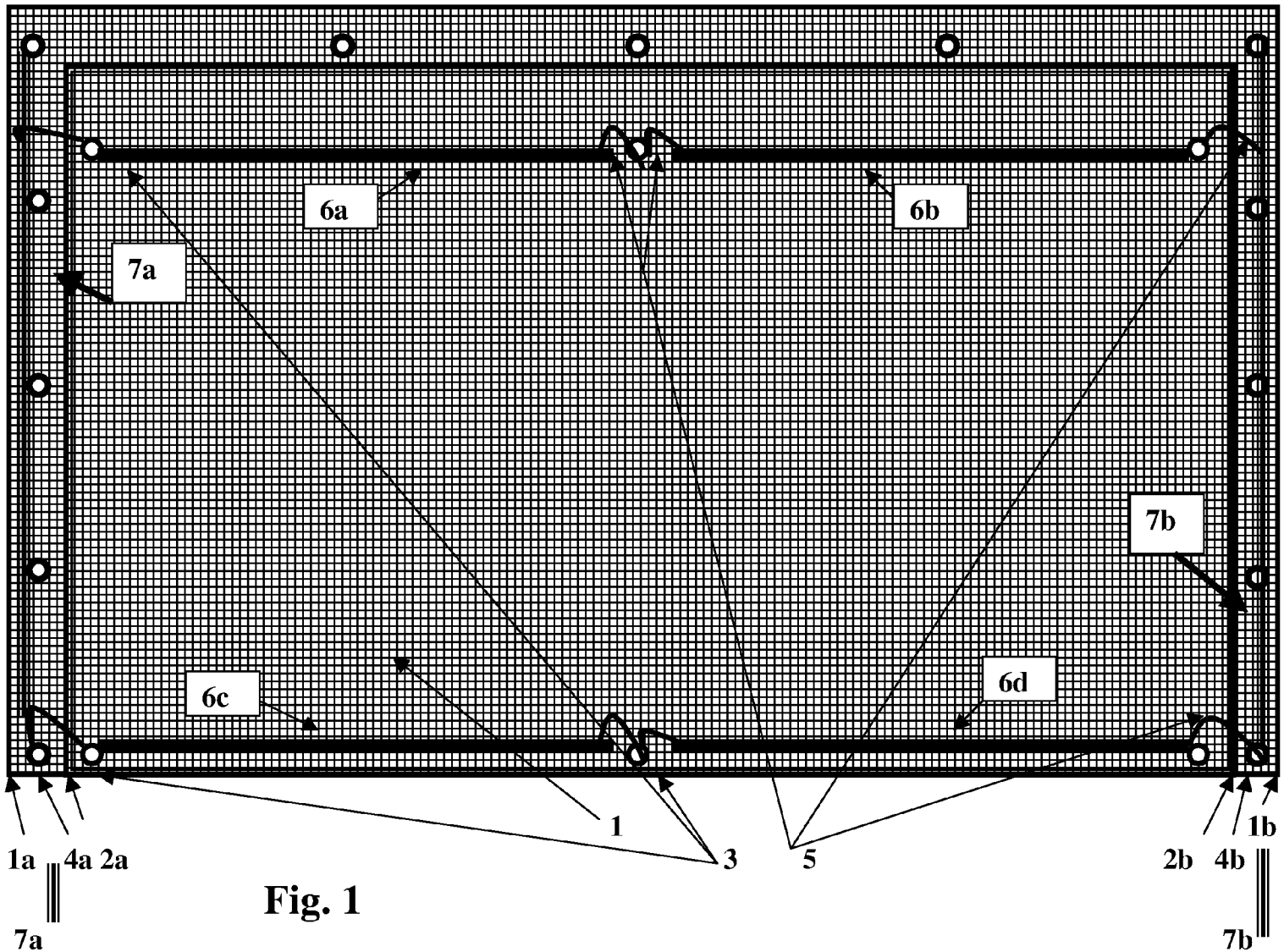
FIG. 1 is a rear inside view of the garage door screen of the present invention with the screen installed over a double car garage door opening.

In the description that follows, like parts are marked throughout the specification and drawings with the same reference numerals, respectively. In some instances, proportions have been exaggerated and are not to scale in order to more clearly depict certain features of the invention.

Figure 2:
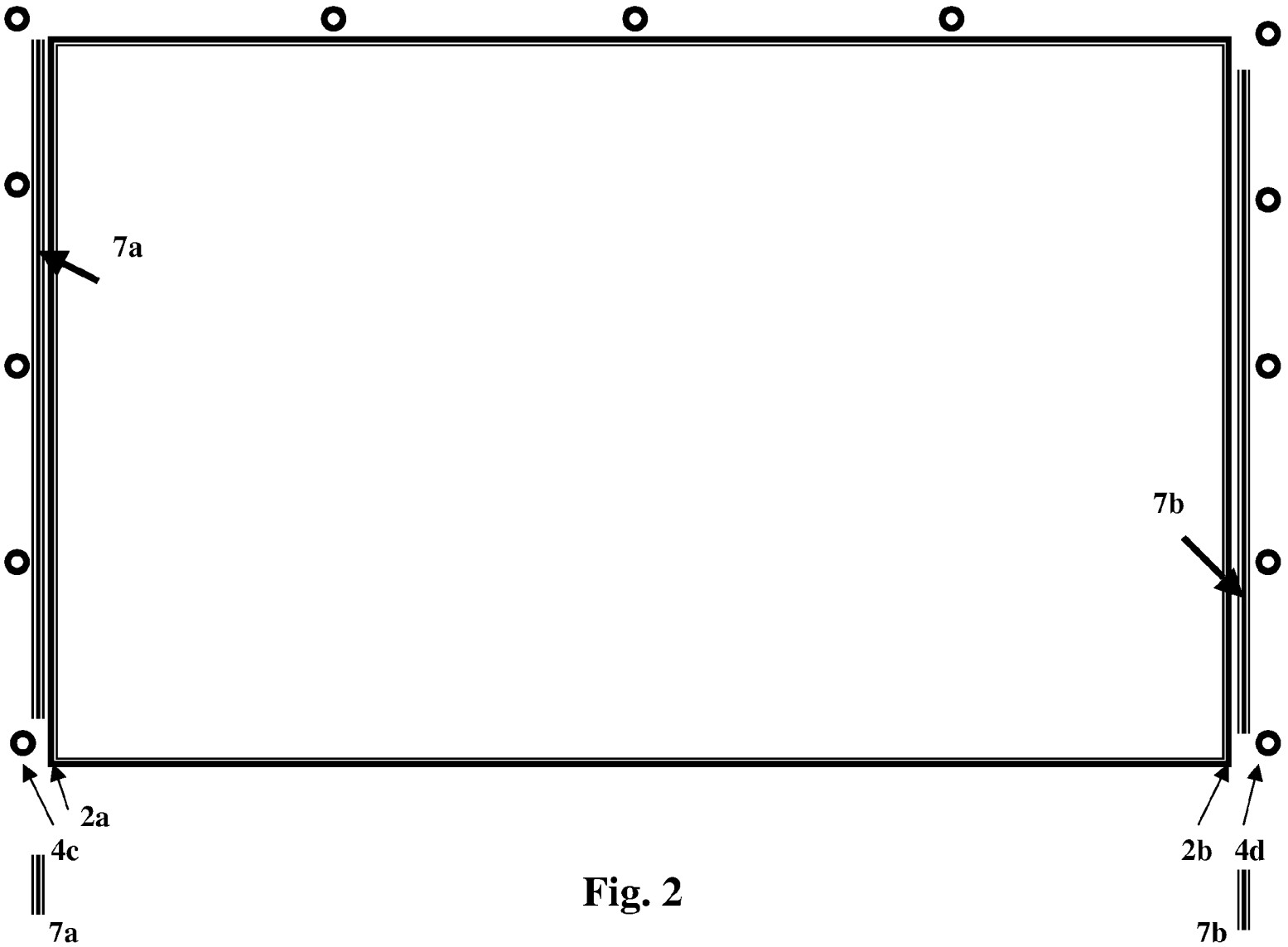
FIG. 2 depicts a rear inside view of a double car garage door opening after initial installation of screw and snap fasteners snaps around the perimeter of a wood garage door frame.
Figure 3:
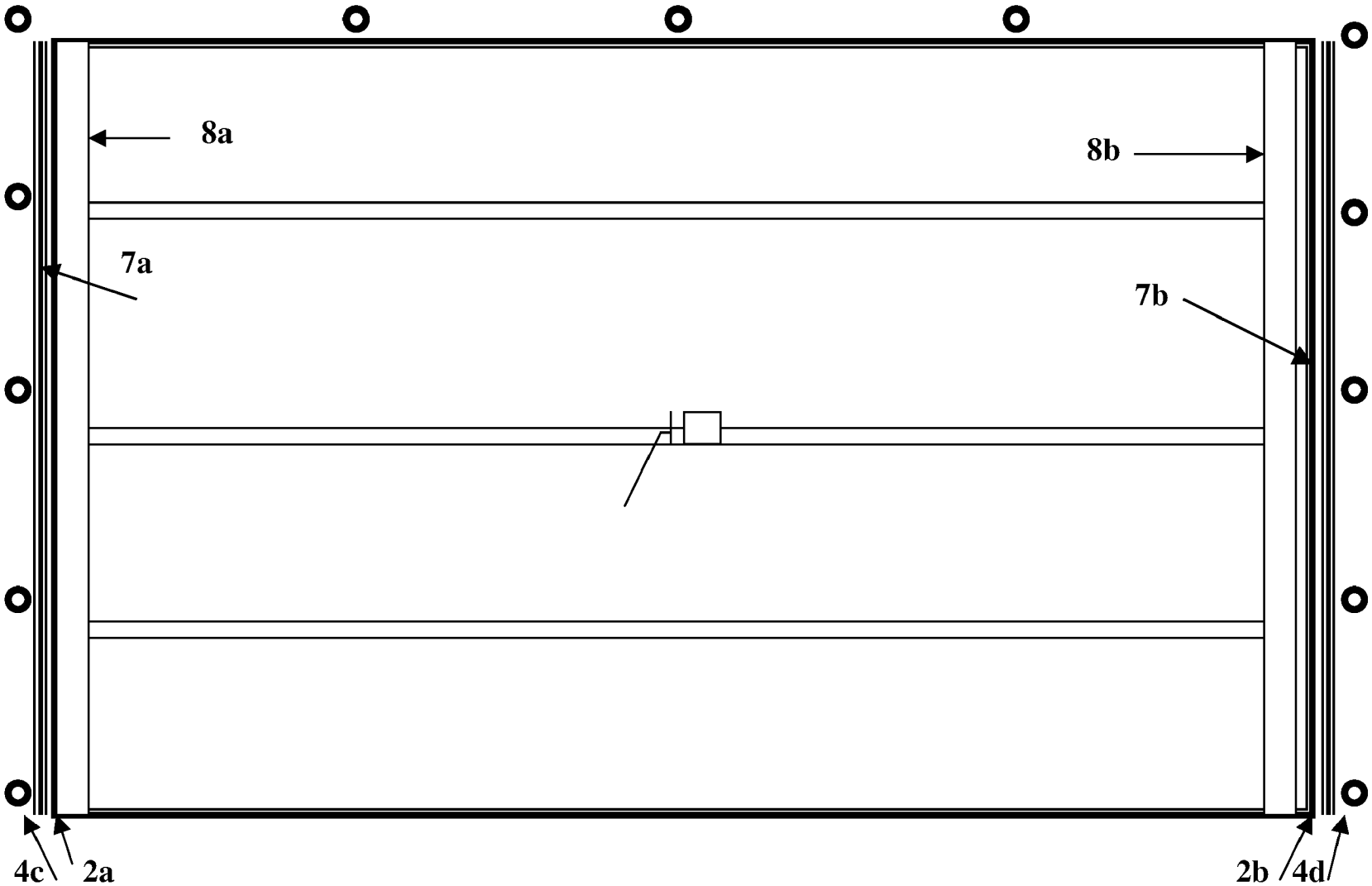
FIG. 3 depicts a rear inside view of a closed double car garage door, showing the snaps around the perimeter of the wood garage door frame.
Figure 4:
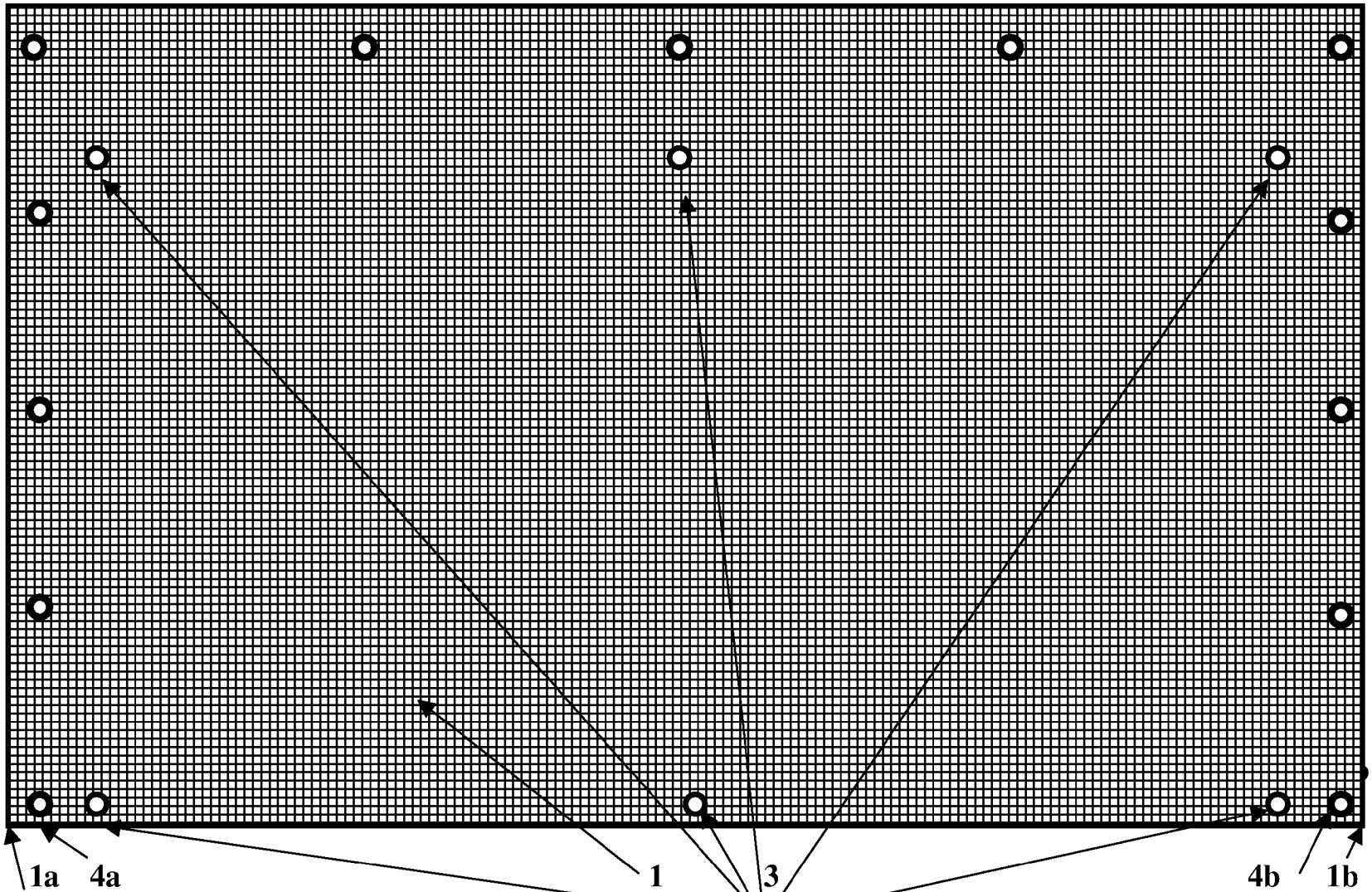
FIG. 4 is a customized double car garage door screen of the present invention after grommets and end-caps have been pre-installed.

For the customizable garage door screen 1 for the double car garage configuration of FIG. 1, the screen size is approximately 91 inches by 199 inches, which is at least four inches longer in height and width than the average double car garage door frame in the United States. The component parts for one embodiment of the present invention will include: 13 screw and snap fasteners (note that screw and snap fasteners are ubiquitous and comprise a self-tapping screw that protrudes through the center of a circular inside snap portion 4*c* (left bottom corner) and 4*d* (right bottom corner), FIGS. 2, 3 and 5 (hereinafter "snap portion" or "snap(s)" are equivalent expressions) and secures it against anything to which it is tightened with a conventional screw driver (in this case a wood garage door frame where the lower left edge starts at 2*a*, and the lower right edge starts at 2*b*, FIGS. 1-3, and 5), and an end-cap portion 4*a* (left bottom corner) and 4*b* (right bottom corner), FIGS. 1 and 4 (hereinafter "end-cap(s)" is used in equivalent manner) which is separately attached using special pliers to the material to be fastened thereto, which in this case is the screen itself. See FIG. 4). These end-caps will be pre-installed around the screen's perimeter as shown in FIG. 4, (4*a* and 4*b* are only representative starting and ending points from left to right going around the screen's perimeter in clockwise fashion) with four of the thirteen end-caps fastened approximately ½ inch by ½ inch in from each corner (as example, 1*a* and 1*b*, FIGS. 1 and 4 depict the lower left and lower right edges of the screen 1), and the other nine end-caps placed approximately ½ inch in from each of the three sides (left, top and right) and equidistant between each of the 4 corner end-caps, three on each side; four 65 inch elastic straps FIGS. 1 and 5, 6*a* (upper left elastic strap), 6*b* (upper right elastic strap), 6*c* (lower left elastic strap) and 6*d* (lower right elastic strap) stretchable to 98 inches and having ¼ inch diameter in thickness hooks 5 (hereinafter "hook(s)" collectively), FIGS. 1 and 5, on the ends of each strap; and six ½ inch diameter holed grommets 3, FIGS. 1 and 4, (hereinafter grommet(s) is used in equivalent manner collectively) pre-installed on the screen, three going horizontally across the top, each placed approximately eight inches down from the top edge of the screen 1, one in the middle of the screen and the other two four inches in from each side. The bottom three grommets are configured with the same dimensions as the top three grommets and are approximately one inch up from the screen's bottom edge defined as the line between 1*a* and 1*b*, FIGS. 1 and 4.

FIG. 1 shows the outer hooks 5 of the upper left elastic strap 6*a* and lower left elastic strap 6*c* engaged to the left garage door guide rail 7*a* (left guide rail) and the upper right elastic strap 6*b* and lower right elastic strap 6*d* engaged to the right garage door guide rail 7*b* (right guide rail). Note that the upper left elastic strap 6*a* and upper right elastic strap 6*b* can alternatively engage the left vertical side 8*a* and the right vertical side 8*b* of the bottom back portion of the garage door when it is opened, FIGS. 3 and 5.

Figure 5:
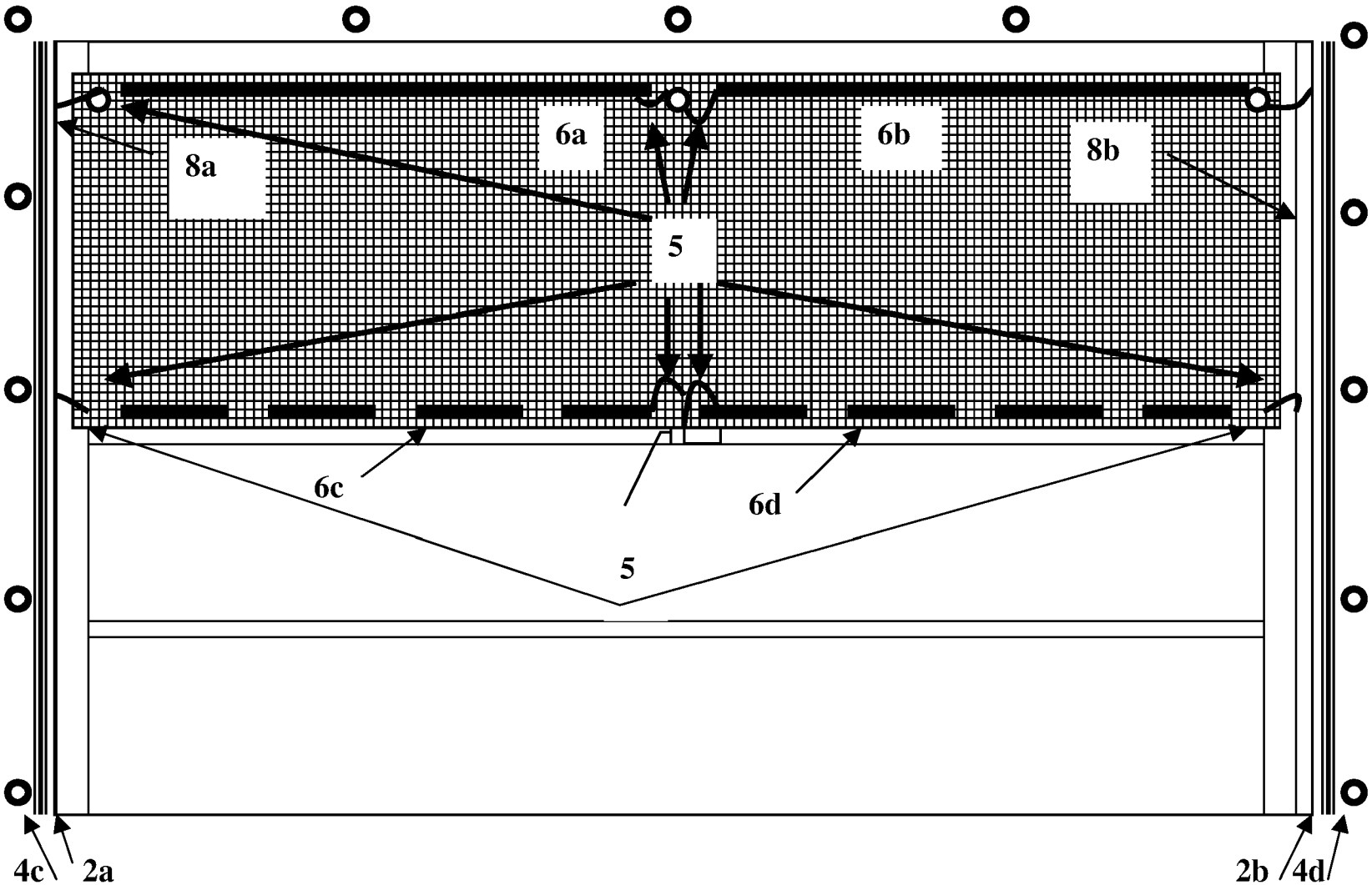
FIG. 5 depicts a rear inside view of a closed double car garage door with the garage door screen of the present invention folded and stored therein.

FIG. 5 shows how the present invention stores the garage door screen 1 safely inside the garage door itself using the four provided elastic straps 6*a*-6*d*, and their attached hooks 5 to hold it in place on the back, inside of the garage door after the screen 1 is folded in half. The top and bottom edges of the garage door screen grommets 3 are aligned after folding so that the hooks 5 of two of the elastic straps, 6*a* and 6*b* simultaneously attach them from the shared middle grommets 3 through the two shared side grommets 3 (hereinafter "top middle grommet" and "two top outer grommets", and "bottom middle grommet" and "two bottom outer grommets" are equivalent expressions that refer to "shared middle grommets" and "two shared side grommets", respectively) on the left vertical side 8*a* and the right vertical side 8*b* of the top back portion of the garage door, respectively, and the other two elastic straps, 6*c* and 6*d* are hooked together inside the fold of the screen 1 at the midway point and stretched to either side to left vertical side 8*a* and right vertical side 8*b* of the middle back portion of the garage door, respectively.

To open a side of the garage door screen 1 for egress and ingress, one simply unhooks the lower elastic strap 6*c* or 6*d*, after unsnapping from one to four of the end-caps starting at 4*a* or 4*b*, respectively, depending on the side to be opened. The number of snaps to be unsnapped depends on the required height. Then the chosen elastic strap, 6*c* or 6*d* is lifted upwards and its hook 5 just released from the left guide rail 7*a* or right guide rail 7*b* corresponding to which side is being opened is placed inside the upper grommet 3 on that side, or alternatively attached to one of the upper elastic straps, 6*a* or 6*b*. If the entire bottom half of the garage door screen is to be opened, both elastic straps, 6*c* and 6*d* would be released from the left and right guide rails 7*a* and 7*b*, respectively, and the number of snaps on each side would be unsnapped according to the desired height. Then the freed hooks 5 from both sides are lifted and attached inside the respective grommets 3 on each side.

The previously described embodiments of the present invention have many advantages. Although the present invention has been described in considerable detail with reference to certain preferred embodiments thereof, other alternative embodiments are possible. Therefore, the spirit and scope of the claims should not be limited to the description of the preferred embodiments, nor the alternative embodiments, contained herein.

What is claimed is:

1. A customizable garage door screen for installation upon a garage door frame both the screen and the frame having four corners comprising, in combination:

(a) a plurality of screw and snap fasteners each having an end-cap and a corresponding snap, each end-cap being attached to the four corners of the screen and attachable to the corresponding snap installed on the four corners of the frame and at positions in symmetrical manner on both the screen and the frame to form a tight enclosure against the frame when each end-cap and corresponding snap are fastened together;

(b) at least six grommets attached to the screen, three of said at least six grommets comprising a top middle grommet and two top outer grommets being spaced across a top portion of the screen and another three of said at least six grommets comprising a bottom middle grommet and two bottom outer grommets being spaced across a bottom portion of the screen; and (c) at least four elastic straps having hooks at each end, including an upper left elastic strap and an upper right elastic strap which are both hooked to the top middle grommet with the upper left elastic strap and the upper right elastic strap both stretching the screen outward through each of the two top outer grommets in each horizontal direction to stabilize the screen to the frame, said at least four elastic straps further including a lower left elastic strap and a lower right elastic strap which are hooked to the bottom middle grommet with the lower left elastic strap and the lower right elastic strap both stretching the screen outward through each of the two bottom outer grommets in each horizontal direction, the lower left elastic strap hooked to a left garage door guide rail and the lower right elastic strap hooked to a right garage door guide rail.

2. The customizable garage door screen of claim 1 wherein the upper left elastic strap is hooked to the left garage door guide rail and the upper right elastic strap is hooked to the right garage door guide rail.

3. The customizable garage door screen of claim 1 wherein the upper left elastic strap engages a left vertical side of a bottom of an open garage door positioned above the screen and the upper right elastic strap engages a right vertical side of the bottom of the open garage door.

4. The customizable garage door screen of claim 1 wherein said at least four elastic straps having hooks at each end are further used to store the screen inside the back of a garage door.

5. The customizable garage door screen of claim 2 wherein said at least four elastic straps having hooks at each end are further used to store the screen inside the back of a garage door.

6. The customizable garage door screen of claim 3 wherein said at least four elastic straps having hooks at each end are further used to store the screen inside the back of a garage door.

7. The customizable garage door screen of claim 1 wherein said lower left elastic strap and said lower right elastic strap are further used to hold at least one side of the garage door screen partially open for egress and ingress.

8. The customizable garage door screen of claim 2 wherein said lower left elastic strap and said lower right elastic strap are further used to hold at least one side of the garage door screen partially open for egress and ingress.

9. The customizable garage door screen of claim 3 wherein said lower left elastic strap and said lower right elastic strap are further used to hold at least one side of the garage door screen partially open for egress and ingress.

10. The customizable garage door screen of claim 4 wherein said lower left elastic strap and said lower right elastic strap are further used to hold at least one side of the garage door screen partially open for egress and ingress.

11. A method of using a customizable garage door screen, comprising:

(a) attaching at least four end-caps on four corners of the screen and a plurality of additional end-caps on the screen in symmetrical manner between each of said at least four end-caps, (b) attaching at least six grommets to the screen, three of said at least six grommets comprising a top middle grommet and two top outer grommets being spaced across a top portion of the screen and another three of said at least six grommets comprising a bottom middle grommet and two bottom outer grommets being spaced across a bottom portion of the screen, (c) installing at least four snaps on four corners of a garage door frame and a plurality of additional snaps on the frame with snap placement corresponding to said at least four end-caps and said plurality of additional end-caps at positions in symmetrical manner on both the screen and the frame to form a tight enclosure against the frame when each end-cap and corresponding snap are fastened together;

(d) fastening said at least four end-caps to said at least four snaps, and said plurality of additional end-caps to said plurality of additional snaps; and (e) stabilizing the screen against the frame using at least four elastic straps having hooks at each end, said hooks engaging the screen through said at least six grommets.

12. The method of claim 11 wherein said at least four elastic straps of the step of stabilizing further include an upper left elastic strap and an upper right elastic strap which are both hooked to the top middle grommet with the upper left elastic strap and the upper right elastic strap both stretching the screen outward through each of the two top outer grommets in each horizontal direction, the upper left elastic strap hooked to a left garage door guide rail and the upper right elastic strap hooked to a right garage door guide rail, said at least four elastic straps further including a lower left elastic strap and a lower right elastic strap which are hooked to the bottom middle grommet with the lower left elastic strap and the lower right elastic strap both stretching the screen outward through each of the two bottom outer grommets in each horizontal direction, the lower left elastic strap hooked to the left garage door guide rail and the lower right elastic strap hooked to the right garage door guide rail.

13. The method of claim 11 wherein said at least four elastic straps of the step of stabilizing further include an upper left elastic strap and an upper right elastic strap which are both hooked to the top middle grommet with the upper left elastic strap and the upper right elastic strap both stretching the screen outward through each of the two top outer grommets in each horizontal direction, the upper left elastic strap engaging a left vertical side of a bottom of an open garage door positioned above the screen and the upper right elastic strap engaging a right vertical side of the bottom of the open garage door, said at least four elastic straps further including a lower left elastic strap and a lower right elastic strap which are hooked to the bottom middle grommet with the lower left elastic strap and the lower right elastic strap both stretching the screen outward through each of the two bottom outer grommets in each horizontal direction, the lower left elastic strap hooked to the left garage door guide rail and the lower right elastic strap hooked to the right garage door guide rail.

14. The method of claim 11 wherein said at least four elastic straps having hooks at each end are further used to store the screen inside the back of a garage door.

15. The method of claim 12 wherein said at least four elastic straps having hooks at each end are further used to store the screen inside the back of a garage door.

16. The method of claim 13 wherein said at least four elastic straps having hooks at each end are further used to store the screen inside the back of a garage door.

17. The method of claim 12 wherein said lower left elastic strap and said lower right elastic strap are further used to hold at least one side of the garage door screen partially open for egress and ingress.

18. The method of claim 13 wherein said lower left elastic strap and said lower right elastic strap are further used to hold at least one side of the garage door screen partially open for egress and ingress.

19. The method of claim 14 wherein said lower left elastic strap and said lower right elastic strap are further used to hold at least one side of the garage door screen partially open for egress and ingress.

* * * * *